United States Patent [19]

Grassi

[11] Patent Number: 4,560,191

[45] Date of Patent: Dec. 24, 1985

[54] DOOR SECURITY DEVICE

[76] Inventor: Julio J. Grassi, P.O. Box 3516, Federal Way, Wash. 98003

[21] Appl. No.: 512,786

[22] Filed: Jul. 11, 1983

[51] Int. Cl.[4] ..... E05C 17/36

[52] U.S. Cl. ..... 292/264; 24/116 R

[58] Field of Search ..... 292/264, 300, DIG. 16, 292/259; 70/93; 24/116 R, 116 A

[56] References Cited

U.S. PATENT DOCUMENTS

| | | | |
|---|---|---|---|
| 482,227 | 9/1892 | Conner | 292/264 |
| 1,325,538 | 12/1919 | Smith | 292/264 |
| 1,850,367 | 3/1932 | Winter | 292/264 |
| 2,036,679 | 4/1936 | Bourn | 292/264 |
| 2,790,663 | 4/1957 | Sarver | 292/264 |
| 2,816,431 | 12/1957 | Harney | 292/264 X |
| 2,995,919 | 8/1961 | Davis | 70/93 |
| 3,720,431 | 3/1973 | Oliver et al. | 292/264 |

FOREIGN PATENT DOCUMENTS

| | | | |
|---|---|---|---|
| 148095 | 12/1954 | Sweden | 24/116 R |
| 341625 | 1/1931 | United Kingdom | 24/116 R |

*Primary Examiner*—Gary L. Smith
*Assistant Examiner*—Russell W. Illich
*Attorney, Agent, or Firm*—Robert R. Tipton

[57] ABSTRACT

A security device for a door utilizes a first bracket member attached proximate one jamb of a door with a chain attached to said bracket and adapted to be fastened to a second chain engaging bracket member fastened proximate the other jamb of the door. The chain engaging bracket generally defines a U-shaped member having a first leg, a second leg and a saddle. The first leg is adapted to be attached to the jamb or building frame adjacent the door. The second leg comprises slots adapted to receive the links of a chain proximate the end of the legs. The saddle also comprises a slot adapted to receive a link of the chain. The chain is wrapped around the chain engaging bracket whereby a link of the chain is first received and engaged in the slot in the saddle. Then another link of the chain is received and engaged in the slot in the leg distal the slot in the saddle. The path of the chain then passes up for a link to be received and engage a slot in the leg proximal the slot in the saddle. The manner in which the chain is attached to the bracket prevents anyone outside of the building from lifting the chain out of the slot in the saddle using a device passing through a hole in the door or between the jamb and the door yet permits the person inside the building to quickly release the chain. The bracket can also define an angle shape having slots at the top, side or bottom of the angle leg.

3 Claims, 11 Drawing Figures

DOOR SECURITY DEVICE

BACKGROUND OF THE INVENTION

This invention relates generally to door security devices and in particular to door security devices using a bracket member adapted to receive a chain.

Most of the door security devices of the prior art comprised rigid bars adapted to pass across the door and be received in a latch on either side.

One device utilized a rod bent at one end to act as the pin for the door hinge. The bar reached across to the other side of the door to engage a latch attached to the door jamb.

Other devices utilized bars hinged at one side to swing vertically and rest on a bracket in the opposite side of the door. The bar was adapted to telescope so that it would be adjustable for all sizes of doors.

Still other devices used heavy bar members having latch mechanisms of various kinds at the end for release at the bar member to open the door.

The novelty in many of these devices generally rested in the latching mechanism.

Chain devices have been used in which the chain is attached to a bracket on one side of the door and received in a hinged, spring loaded catch engaging the links of the chain on the opposite side of the door.

A latching device for a gate utilized a flat plate with a T-slot adapted to receive the link of a chain wrapped around a post.

Generally such devices of the prior art were expensive to manufacture and not necessarily adaptable to use on a hinged door.

SUMMARY OF THE INVENTION

A security device for a door comprises, basically, a first bracket member attached proximate one jamb of a door, a chain having one end connected to the first bracket member and adapted to engage a second bracket member attached proximate the other jamb of the door, the bracket member comprising a generally U-shaped member having a first leg, a second leg and saddle therebetween, the first leg being adapted to be attached proximate the jamb of the door and the second leg comprising a pair of first and second slots disposed proximate each end of the second leg and the saddle comprising at least one slot disposed at the upper end of the saddle. The slots are adapted to receive and engage links of the chain.

The second bracket member can, in the alternative, comprise an angle member having a first leg adapted to attach to the jamb of the door and a saddle disposed approximately perpendicular to the first leg and having therein a pair of slots proximate the top edge of the angle and a single slot proximate the bottom edge of the angle, the slots being adapted to receive and engage links of the chain.

It is, therefore, an object of the present invention to provide a security device for a door.

It is a further object of the present invention to provide a security device for a door utilizing a chain and a bracket member defining a generally "U" shape having a slot at one end of the saddle portion of the "U" and a pair of slots proximate each end of one leg of the U-shaped member, the slots adapted to receive links of the chain wrapped around said bracket.

It is still a further object for the present invention to provide a security device for a door utilizing a chain and a bracket member having slots therein adapted to receive a link of the chain and to hold the chain in engagement against horizontal forces and a further slot to prevent the chain from being lifted out of the first slot by vertical forces acting on the chain between attachment bracket.

It is still a further object of the present invention to provide an attachment device for a chain utilizing a bracket member having a first slot adapted to secure the chain against horizontal forces acting on the chain and a second, separately disposed slot adapted to prevent vertical forces from removing the chain from the first slot.

These and other objects of the present invention will become manifest upon study of the following detailed description when taken together with the drawings.

DESCRIPTION OF THE PREFERRED EMBODIMENT

Figure 1:
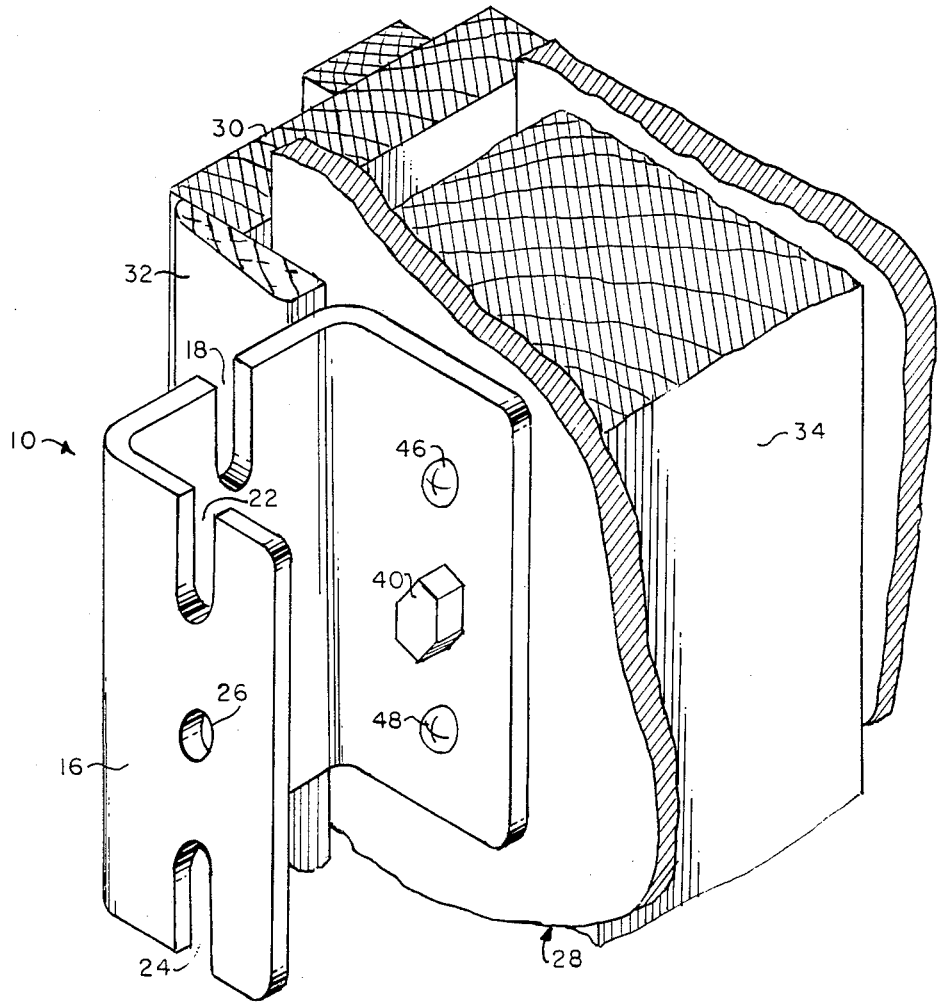
FIG. 1 is an isometric view of the attachment bracket for a chain shown attached to the jamb or building structure adjacent a door.

With reference to FIG. 1 there is illustrated the chain catch bracket 10 of the present invention comprising, basically, a first leg 12, a saddle 14, and a second leg 16, all defining a generally U-shaped bracket member 10.

Bracket member 10 further comprises a slot 18 in the upper or top end of saddle 14 and a similar slot 20 (FIG. 3) at the lower or bottom end of saddle 14. Slot 20 will permit bracket member 10 to be installed on either side of a door.

A slot 22 is disposed at the top or upper end of bracket leg 16, while a further slot 24 is located at the lower or bottom end of bracket leg 16.

In addition a padlock hole 26, adapted to receive the link 28 of padlock 27 (FIG. 2), is located between slots 22 and 24 in bracket leg 16.

Chain catch bracket 10 is, typically, attached to wall 28 proximate door jamb 30 and adjacent door trim 32. A bolt hole 38 is adapted to receive a fastening bolt or lag screw 40, or the like, which passes through wallboard 36 and into wallstud 34 of the building frame. A pair of holes 42 and 44 in leg 12 of bracket 10 are adapted to receive screws 46 and 48, respectively, to maintain U-shaped bracket 10 in a generally vertical position as shown in FIG. 1.

Figure 2:
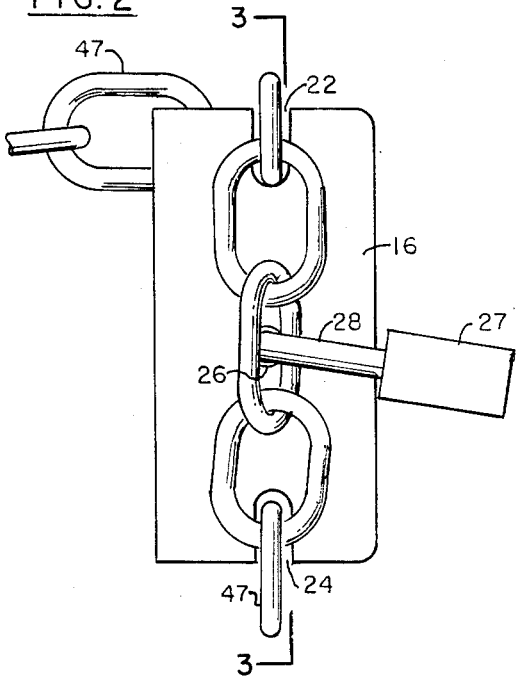
FIG. 2 is a side elevational view of the bracket member of FIG. 1 showing the arrangement of the chain passing through the slots along the bracket member and the manner in which the chain can be locked in place.

With reference to FIG. 2 there is illustrated a side elevational view of bracket member 10 of FIG. 1 showing the manner in which chain 47 engages slots 18, 24 and 22.

Figure 3:
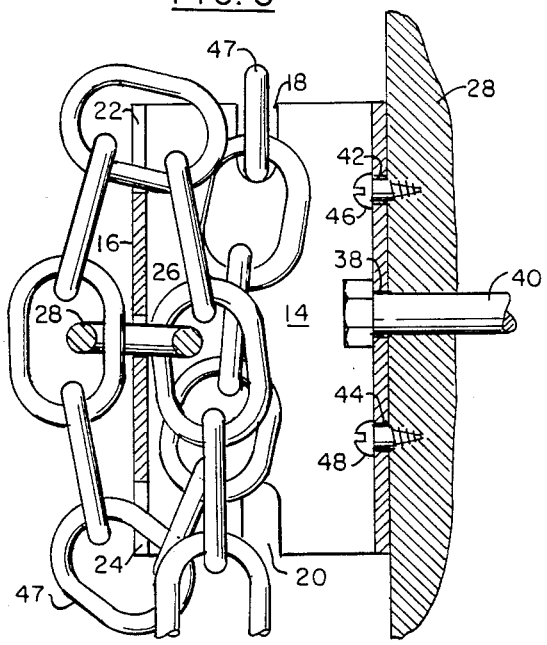
FIG. 3 is a front elevational view of the bracket member shown in FIGS. 1 and 2 taken at lines 3—3 of FIG. 2.

FIG. 3 illustrates a front elevational view of bracket 10 further illustrating the manner in which chain 47 engages slots 18, 24 and 22.

Figure 4:
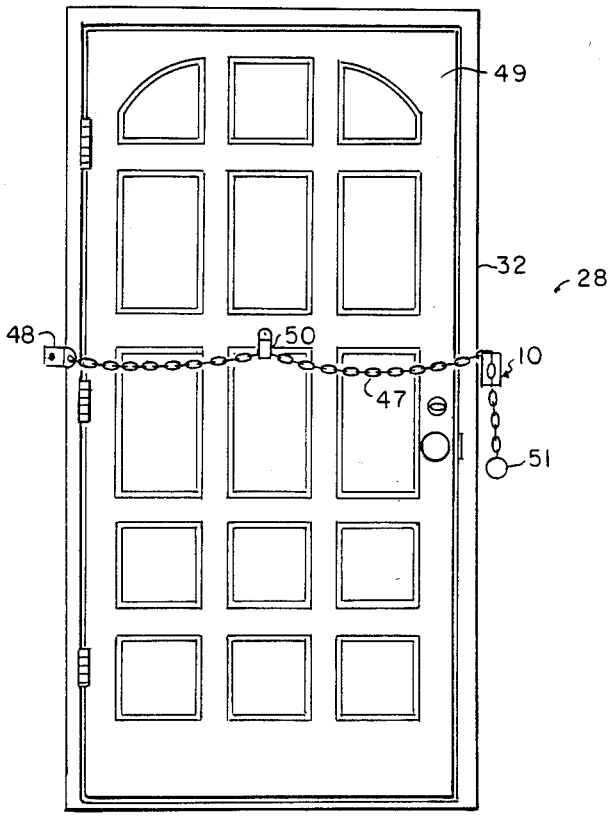
FIG. 4 is an elevational view of the installed door security device of the present invention.

In particular, it should be noted that chain 47, after passing in front of door 49 (FIG. 4), first engages slot 18 with one of its links, then passes down in between leg members 12 and 16 to have another of its links engage slot 24. Chain 47 then passes along the outside of second leg 16 to have yet another of its links engage slot 22 at the top of leg 16. Chain 47 then passes down again between first and second legs 12 and 16, respectively, to be held at in that position by gravity.

A padlock 27 is adapted to have its link 28 pass through both a link of chain 47 and hole 26 in second leg 16 of bracket member 10 thereby further securing chain 47 to bracket 10.

When chain 47 engages bracket member 10 in this manner it can be seen that any upward forces applied to chain 47 between bracket member 10 and end bracket member 48 (FIG. 4) cannot lift chain 47 out of slot 18.

In addition it can also be seen that any horizontal forces tending to pull against bracket 10 will cause the next link behind the link engaging slot 18 to be pulled against saddle 14 and prevent release of chain 47 from bracket 10.

It will also be noted that with padlock 27 removed from bracket 10, chain 47 can be rapidly removed from bracket 10 by grasping chain 47 proximate ball 51 and quickly unwrapping it, first from slot 22, then from slot 24 and finally from slot 18, in the event of an emergency requiring rapid exodus from the building.

Figure 5:
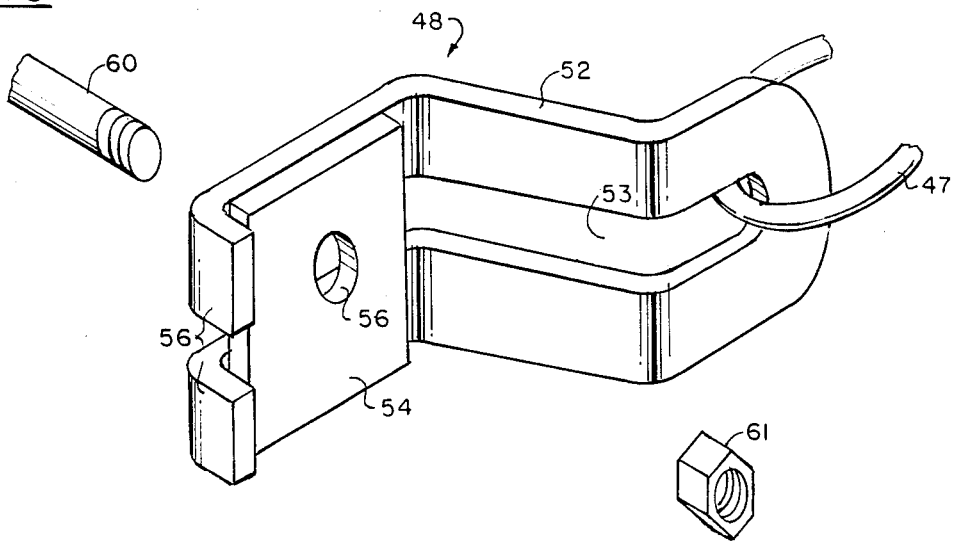
FIG. 5 is an isometric view of the first embodiment of the bracket member used to attach the other end of the chain proximate the other side of the door.

With reference to FIG. 5 there is this illustrated fixed end bracket 48 which is attached to the building structure proximate the side of the door 49 opposite chain catch bracket 10.

Fixed end bracket 48 shown in FIG. 5 comprises, basically, a bracket body 52 defining roughly a "Z" shape and containing a slot 53 adapted to receive the end link of chain 47.

As shown in FIG. 5, slot 53 runs longitudinally the length of bracket body 52.

The end of bracket body 52 distal chain link 47 further comprises a pair of fixed end bracket washer stops 56. Stops 56 are adapted to prevent body member 52 from sliding out from under washer 54 when horizontal forces are applied to chain 47.

Washer 54 comprises a hole 56 adapted to receive bolt 60 or a lag screw (not shown) which is fixedly attached to building wall 28 similar to the manner of attaching chain catch bracket 10 to building wall 28 as previously described.

A nut 61, adapted to engage bolt 62, typically attaches fixed end bracket number 48 to wall 28.

Figure 6:
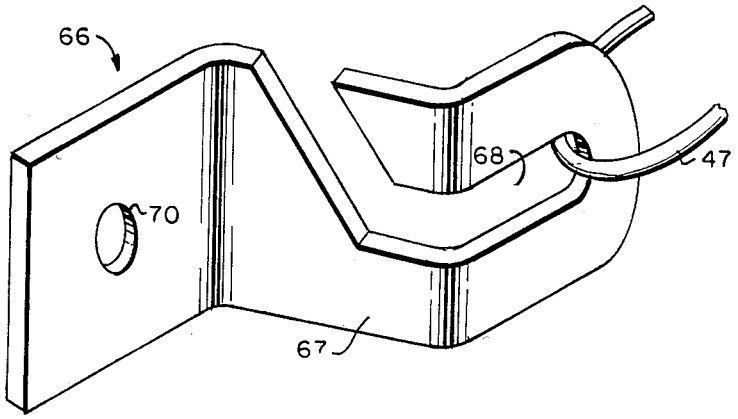
FIG. 6 is a further embodiment of the bracket member adapted to attach the chain to the other side of the door.

A further embodiment of a fixed bracket member attached to the opposite side of the door 49 from chain catch bracket 10 is illustrated in FIG. 6 and comprises, basically, a generally Z-shaped body member 67 having a slot 68 therein opening to one side of body member 67 and adapted to receive the end link of chain 47. A hole 74 is also provided in fixed end bracket 66 of body member 67 for attaching fixed bracket 66 to wall 28 in a manner similar to that described for fixed end bracket 48.

It will be noted that fixed end bracket 66 does not require any washers 54 or stops 56 as shown in FIG. 5.

With reference to FIGS. 7A, 7B, 7C, 7D and 7E there is illustrated various configurations of chain catch bracket 10, in particular, brackets 10A, 10B, 10C, 10D and 10E.

Each of the brackets illustrated performs the same function as chain catch bracket 10 shown in FIG. 1. That is, the arrangement of slots and the manner in which chain 47 engages those slots prevents release of chain 47 from bracket members 10A, 10B, 10C, 10D and 10E by horizontal and vertical forces applied to chain 47 (not shown in FIGS. 7A, 7B, 7C, 7D, and 7E). The path of chain 47 is indicated by arrows 47A, 47B, 47C, 47D and 47E in the respective figures.

Figure 7A:
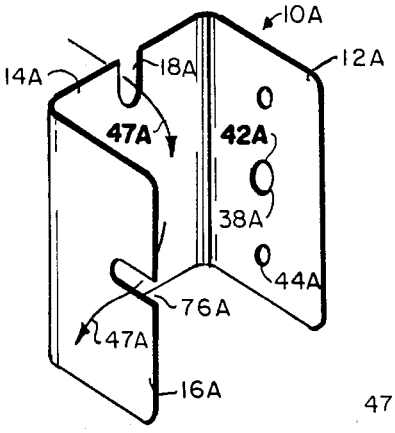
FIGS. 7A, 7B, 7C, 7D, and 7E are schematic isometric views of further embodiments of the chain catch bracket of the present invention.

In particular, with reference to FIG. 7A, a link of chain 47, the path of which chain is indicated by arrows 47A, will first engage slot 18A of saddle 14A then next engage slot 76A along the edge of second bracket leg 16A. For this configuration slot 76A will prevent release of a link of chain 47 from slot 18A.

Figure 7B:
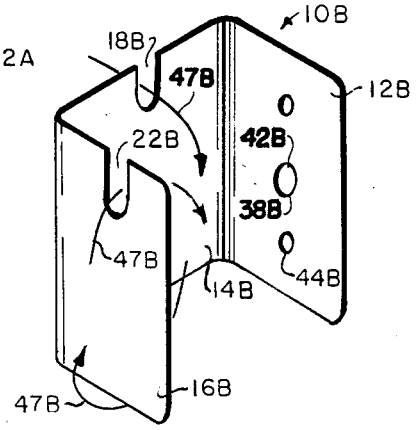

With reference to FIG. 7B a link of chain 47, the path of which chain is indicated by arrows 47B, would first engage slot 18B then pass down under the bottom of second leg 16B and up to engage slot 22B at the top of second leg 16B.

Slot 22B will prevent any upward forces on chain 47 from removing a link of chain 47 from slot 18B.

Figure 7C:
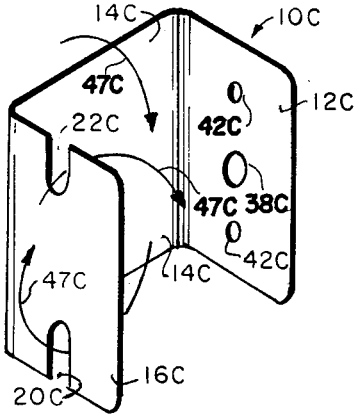

With reference to FIG. 7C, chain 47, the path of which chain is indicated by arrows 47C, is adapted to pass over the top of saddle 46C then down to have one of its links engage slot 20C at the bottom of first second leg 16C and then up to have one of its links engage slot 22C then to hang down between first leg 12C and second leg 16C.

Thus it can be seen that any upward forces on chain 47 will cause the link of chain 47 engaging slot 26C to be pulled tighter into slot 26C. In addition, the chain link engaging slot 22c proximate the top of second leg 16C will further prevent chain 47 from being released from slot 26C.

Figure 7D:
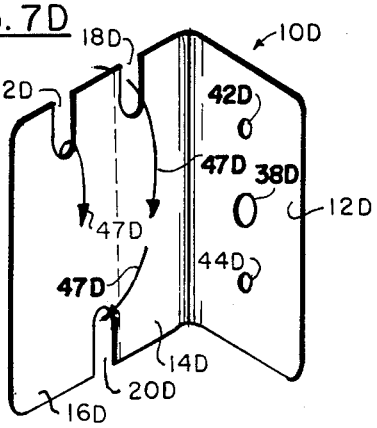

With reference to FIG. 7D, chain 47, the path of which chain is indicated by arrows 47D, is adapted to have one of its links first engage slot 18D with another of its links to then engage slot 20D proximate the bottom of saddle 14D and then pass up to have one of its links engage slot 22D and then pass down in front, on the same side, of leg 16D as first leg 12D.

Thus it can be seen that slot 20D will hold the link of chain 47 in slot 18D should any vertical forces be applied to chain 47. Slot 22D further causes the link of chain 47 to be retained in slot 20D.

It can also be seen that the leg 16D may be disposed at an angle between approximately 90 and 180 degrees to the plane of the saddle 14D. FIG. 7D shows an angle of approximately 180 degrees between the leg 16D and saddle 14D while FIGS. 7B and 7C show angles of approximately 90 degrees between the legs (16B and 16C) and saddles (14B and 14C, respectively).

Figure 7E:
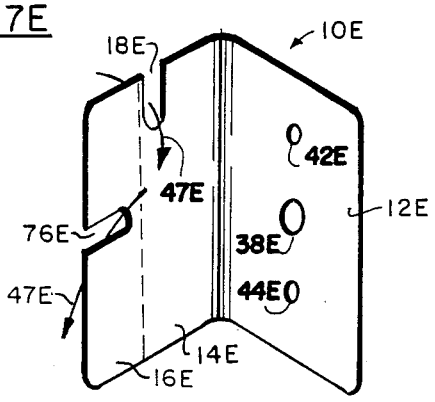

With reference to FIG. 7E, a link of chain 47, the path of which chain is indicated by arrows 47E, is adapted to first engage slot 18E then pass in front of and on the same side of saddle 14E as first leg 12E to have another link of chain 47 engage slot 76E along the side of saddle 14E.

Thus, in a manner similar to that described for FIG. 7A, the link of chain 47 engaging slot 76E will prevent the release of a link of chain 47 in slot 18E when a vertical force is applied to chain 47.

Thus is described the door security device of the present invention.

I claim:

1. A security device for a door comprising a first bracket member attached proximate one jamb of said door, a second bracket member attached proximate the other jamb of said door, said second bracket comprising a generally U-shaped channel member having a first leg, a second leg and a saddle therebetween, said first leg adapted to be attached proximate said other jamb of said door, said saddle being disposed vertically with the open end of said U-shaped member distal said saddle facing horizontally away from said door, said second leg comprising a top end, a bottom end, means defining a first and second slot disposed, respectively, proximate the top and bottom ends of said second leg, said saddle comprising a top end, means defining a third slot disposed proximate said top end of said saddle, a chain having a first end and a second end, said first end connected to said first bracket member with one link of said chain located between said first bracket member and said second end of said chain engaging said third slot of said second bracket member proximate said top end of said saddle, another link of said chain located between said third slot and said second end of said chain engaging said second slot of said second bracket member proximate the bottom end of said second leg, and another link of said chain located between said second slot and said second end of said chain engaging said first slot of said second bracket member proximate the top end of said second leg.

2. An attachment device for a chain comprising a bracket member comprising a generally planar first leg, a generally planar second leg, and a generally planar saddle, the plane of said first leg disposed generally perpendicular to the plane of said saddle, the plane of said second leg disposed at an angle between approximately 90 and 180 degrees to the plane of said saddle, means for attaching said first leg to a support, said generally planar saddle being disposed perpendicular to said support and in a vertical plane, said second leg further comprising a top end a bottom end, means defining a slot disposed in the top end of said second leg, said saddle comprising a top end, means defining a slot disposed in the top end of said saddle and a chain having a first end and a second end, with one link of said chain located between said first end and said second end engaging said slot in said saddle of said bracket member proximate said top end of said saddle, another link of said chain located between said slot in said saddle and said second end of said chain engaging the bottom end of said generally planar second leg, and another link of said chain located between said bottom end of said generally planar second leg and said second end of said chain engaging said slot in the top end of said second leg.

3. An attachment device for a chain comprising a chain, a bracket member comprising a generally planar first leg, a generally planar second leg comprising a bottom edge, and a top edge, a generally planar saddle comprising a top edge, the plane of said first leg disposed generally perpendicular to the plane of said saddle, the plane of said second leg disposed at an angle between approximately 90 and 180 degrees to the plane of said saddle, means for attaching said first leg to a support, said generally planar saddle being disposed perpendicular to said support and in a vertical plane, said second leg further comprising means defining a vertical slot disposed in the top edge of said second leg, said saddle comprising means defining a vertical slot disposed in the top edge of said saddle, and means defining a vertical slot in the bottom edge of said second leg, said chain having a first end and a second end, with one link of said chain located between said first end and said second end engaging said vertical slot in the top edge of said saddle, another link of said chain located between said vertical slot in the top edge of said saddle and said second end of said chain engaging said vertical slot in the bottom edge of said second leg proximate its junction with said saddle, and another link of said chain located between said vertical slot in the bottom edge of said second leg and said second end of said chain engaging said vertical slot in the top edge of said second leg.

* * * * *